US011805377B2

(12) United States Patent
Okimoto

(10) Patent No.: US 11,805,377 B2
(45) Date of Patent: Oct. 31, 2023

(54) MEASUREMENT DEVICE AND MEASUREMENT SYSTEM

(71) Applicant: SONY CORPORATION, Tokyo (JP)

(72) Inventor: Koyuru Okimoto, Tokyo (JP)

(73) Assignee: SONY CORPORATION, Tokyo (JP)

( * ) Notice: Subject to any disclaimer, the term of this patent is extended or adjusted under 35 U.S.C. 154(b) by 17 days.

(21) Appl. No.: 17/250,384

(22) PCT Filed: Jul. 23, 2019

(86) PCT No.: PCT/JP2019/028897
§ 371 (c)(1),
(2) Date: Jan. 14, 2021

(87) PCT Pub. No.: WO2020/022347
PCT Pub. Date: Jan. 30, 2020

(65) Prior Publication Data

US 2021/0297798 A1 Sep. 23, 2021

(30) Foreign Application Priority Data

Jul. 24, 2018 (JP) ..... 2018-138916

(51) Int. Cl.
*H04R 29/00* (2006.01)
*H04R 1/40* (2006.01)

(52) U.S. Cl.
CPC ..... *H04R 29/001* (2013.01); *H04R 1/403* (2013.01); *H04R 29/004* (2013.01)

(58) Field of Classification Search
CPC ..... H04R 29/001; H04R 1/403; H04R 29/004
USPC ..... 381/59, 87, 332, 91, 150, 122, 355, 300; 248/222.51, 220.21, 205.1; 73/1.82; 403/24, 205
See application file for complete search history.

(56) References Cited

U.S. PATENT DOCUMENTS

2012/0328107 A1* 12/2012 Nystrom ..... H04S 7/303 381/17
2020/0068334 A1 2/2020 Magariyachi et al.

FOREIGN PATENT DOCUMENTS

| | | | |
|---|---|---|---|
| CN | 103631270 | A | 3/2014 |
| CN | 103720477 | A | 4/2014 |
| CN | 105611479 | A | 5/2016 |
| CN | 110036655 | A | 7/2019 |
| EP | 3554098 | A1 | 10/2019 |
| JP | 2008-118166 | A | 5/2008 |
| JP | 2010-164863 | A | 7/2010 |
| JP | 2017-028525 | A | 2/2017 |

(Continued)

OTHER PUBLICATIONS

International Search Report and Written Opinion of PCT Application No. PCT/JP2019/028897, dated Oct. 1, 2019, 06 pages of ISRWO.

(Continued)

*Primary Examiner* — Vivian C Chin
*Assistant Examiner* — Con P Tran
(74) *Attorney, Agent, or Firm* — CHIP LAW GROUP

(57) ABSTRACT

A measurement device according to an embodiment includes: a base portion (10), a plurality of pillars (20, 30, 40) in an arc shape not directly facing one another having one end of each connected to the base portion and the other end of each coupled by a coupling portion (60), and a plurality of speakers (70) provided on each of the pillars and having distances to a certain location substantially uniform.

14 Claims, 11 Drawing Sheets

(56) References Cited

FOREIGN PATENT DOCUMENTS

| | | | |
|---|---|---|---|
| WO | 2007/004362 | A1 | 1/2007 |
| WO | 2018/110269 | A1 | 6/2018 |

OTHER PUBLICATIONS

Extended European Search Report of EP Application No. 19841082.
1, dated Aug. 30, 2021, 08 pages.

* cited by examiner

MEASUREMENT DEVICE AND MEASUREMENT SYSTEM

CROSS REFERENCE TO RELATED APPLICATIONS

This application is a U.S. National Phase of International Patent Application No. PCT/JP2019/028897 filed on Jul. 23, 2019, which claims priority benefit of Japanese Patent Application No. JP 2018-138916 filed in the Japan Patent Office on Jul. 24, 2018. Each of the above-referenced applications is hereby incorporated herein by reference in its entirety.

FIELD

The present disclosure relates to a measurement device and a measurement system. More specifically, it relates to the control processing of an output signal according to the motion of a user.

BACKGROUND

A technology that three-dimensionally reproduces, by using a head-related transfer function (HRTF) mathematically expressing how sound reaches the ears from a sound source, a sound image in headphones and the like has been used.

For example, a technology that improves, by handling transfer functions between each sound source of a stereo sound source and one ear as a set, the balance between the overall out-of-head localization and sound has been developed (for example, Patent Literature 1). Furthermore, a technology that can easily select a head-related transfer function that approximates the user's own head-related transfer function has been known (for example, Patent Literature 2).

CITATION LIST

Patent Literature

Patent Literature 1: Japanese Patent Application Laid-open No. 2017-028525

Patent Literature 2: Japanese Patent Application Laid-open No. 2016-201723

SUMMARY

Technical Problem

The above-described conventional technologies, however, merely reproduce the head-related transfer function of the user in a pseudo manner. Because the head-related transfer function varies greatly from person to person, it is desirable that the user's own head-related transfer function be used for information processing such as localization of sound images.

Meanwhile, in order to individually measure the head-related transfer function of the user, there are large burdens such as the arrangement of an adequate measurement environment of low reflections, a need of a long measurement time, and the installation of an output device capable of outputting a wide range of frequencies.

Thus, the present disclosure offers a measurement device and a measurement system capable of obtaining an appropriate head-related transfer function while reducing the burdens concerning the measurement.

Solution to Problem

For solving the problem described above, a measurement device according to one aspect of the present disclosure has a base portion; a plurality of pillars in an arc shape having one end of each close to the base portion and not directly facing one another; and a plurality of acoustic output units installed on each of the pillars and having substantially uniform distances to a certain location.

Advantageous Effects of Invention

According to the measurement device and the measurement system in the present disclosure, an appropriate head-related transfer function can be obtained while reducing the burdens concerning the measurement. Note that, the effects described herein are not necessarily limited and may be any of the effects described in the present disclosure.

DESCRIPTION OF EMBODIMENTS

The following describes exemplary embodiments of the present disclosure in detail based on the accompanying drawings. Note that, in each of the following embodiments, by denoting identical portions by identical reference signs, duplicate description will be omitted. Furthermore, it needs to note that the drawings are schematic and that the relation of dimensions of each element, the ratio of each element, and the like may differ from the reality. Even between the drawings, portions that the relation and ratio of dimensions are different from each other may be included.

1. First Embodiment

1-1. Appearance of Measurement Device in First Embodiment

Figure 1:
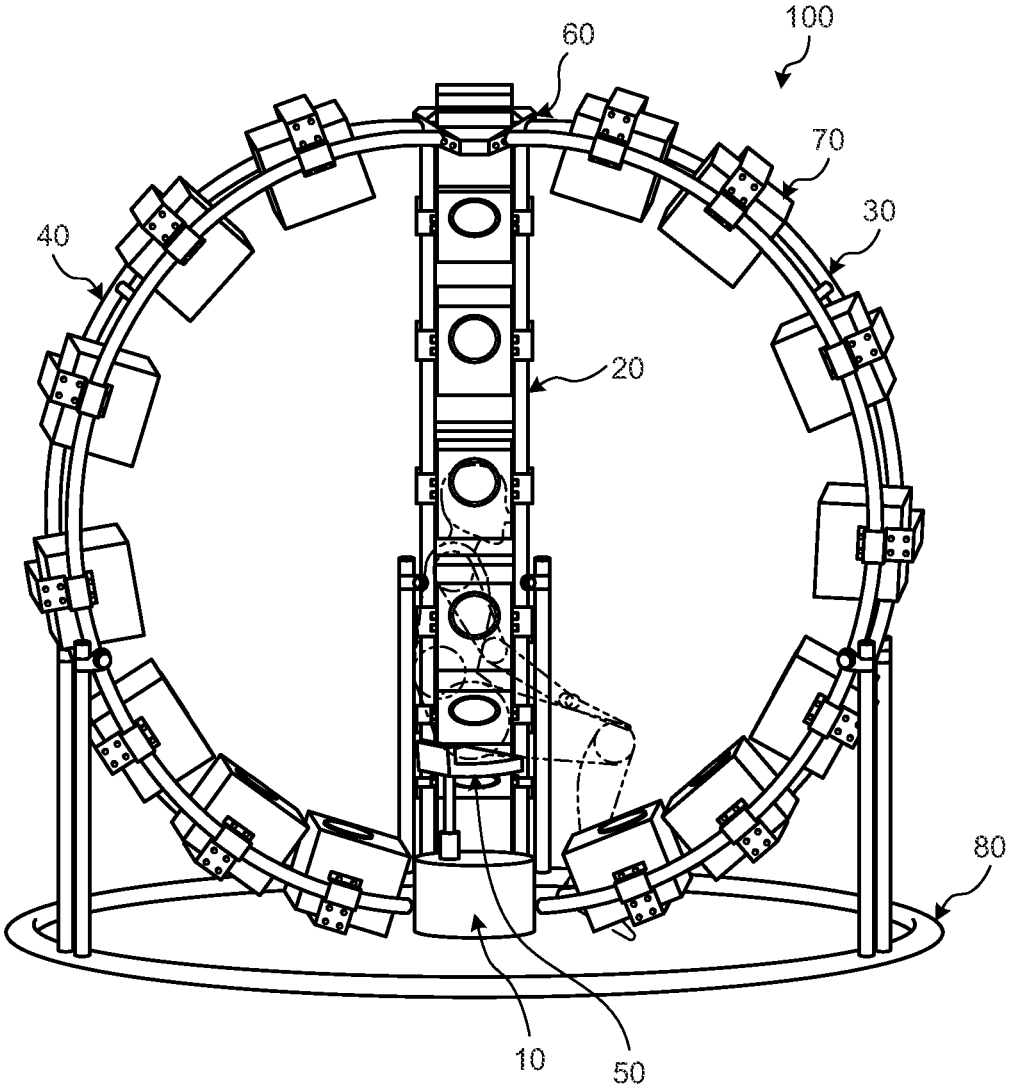
FIG. 1 is a diagram illustrating the appearance of a measurement device according to a first embodiment of the present disclosure.

First, by using FIG. 1 to FIG. 6, an outline of the configuration of a measurement device 100 will be described. FIG. 1 is a diagram illustrating the appearance of the measurement device 100 according to a first embodiment of the present disclosure. The measurement processing in the first embodiment of the present disclosure is performed by the measurement device 100 illustrated in FIG. 1.

The measurement device 100 illustrated in FIG. 1 is a device that performs measurement of data for calculating a head-related transfer function. The head-related transfer function is a function that expresses as a transfer function the change in sound caused by peripheral objects including the shapes of the auricles (auditory capsules), the head, and the like of a human. In general, the measurement data for obtaining a head-related transfer function is acquired by measuring an acoustic signal for measurement by using microphones worn by a human in the auricles, a dummy head microphone, and the like.

The head-related transfer functions used, for example, in the technologies such as 3D sound are often calculated by using the measurement data acquired by a dummy head microphone or the like, an average value of the measurement data acquired from a large number of people, and the like. However, because the head-related transfer function varies greatly from person to person, it is desirable to use the user's own head-related transfer function in order to implement more effective acoustic direction effects. That is, by replacing a general head-related transfer function with the user's own head-related transfer function, the user can be provided with a more realistic acoustic experience.

However, there are various problems to individually measure the head-related transfer function of the user. For example, in order to obtain a head-related transfer function that provides excellent acoustic effects, measurement data of relatively high-density is needed. In order to obtain the high-density measurement data, the measurement data of acoustic signals output to the user from various angles surrounding the user is needed.

Then, in order to measure the acoustic signals output from various angles to the user, there is a need to install a large number of speakers so as to surround the user, or to install a movable speaker.

However, problems may arise even in the above-described measurement methods. That is, when installing a large number of speakers so as to surround the user, the influence of reflection is increased at the time of measurement, because a speaker may also be installed on the opposite side of one speaker or a large number of supporting members for installing the speakers may be installed. Although there is a method that reduces the number of speakers to install and moves each speaker in order to avoid the influence of reflection, in this case, the measurement takes a long time as the measurement work is performed while moving the speaker to various angles. As the measurement takes a longer time, the user is likely to move during the measurement and the appropriate measurement data may be not obtained. In addition, long-time measurement also imposes a heavy physical burden on the user.

Concerning the above-described problems, a measurement device that is configured with a large number of relatively small speakers arranged on supporting members of a single row (for example, a pillar-shaped support member) is conceivable. In this case, either by rotating the supporting members of a single row around the user or by fixing the user on a chair and the like that has a rotation mechanism, the acoustic signals at various angles are measured. According to such a measurement device, the reflection problem is not likely to occur as there is no speaker to face at least. In addition, because the number of measurement points that can be measured at one time is increased, the measurement time can be made short relative to moving a small number of speakers.

However, in order to obtain an appropriate head-related transfer function, it is desirable that not only the acoustic signal of a specific frequency but also the acoustic signals of a wide range of frequencies including as much as possible the audible range of the user be measured. When a speaker of a relatively small type is used for the measurement, due to the acoustic characteristics, the frequencies that are output may extremely be limited.

As in the foregoing, in order to obtain the measurement data of the head-related transfer function corresponding to an individual user, there are various problems. The measurement device 100 in the present disclosure solves the above-described problems by the configuration described below.

As illustrated in FIG. 1, the measurement device 100 has a configuration in which, with a base portion 10 and a bottom frame 80 as a base, three supporting members are extending from the base portion 10 and coupled at a coupling portion 60 at the top. The supporting member is a member to support speakers 70 that output acoustic signals. In the example of FIG. 1, the supporting members are three pillars of a pillar 20, a pillar 30, and a pillar 40 of an arch shape placed upright with respect to the base portion 10.

The pillar 20, the pillar 30, and the pillar 40 each support a plurality of speakers 70 and are placed so as to extend in an arc shape from the base portion 10 and not directly face one another. Specifically, the three pillars have an arc shape that extends toward a direction to be away from one another (outside of the base portion 10) from the base portion 10 and then extends in a direction to be close to one another toward the base portion 10 again. Furthermore, the pillar 20, the pillar 30, and the pillar 40 extend from the base portion 10 with substantially the same intervals in the circumferential direction with a virtual axis connecting the base portion 10 and the coupling portion 60 as a center. That is, the pillar 20, the pillar 30, and the pillar 40 are provided at the base portion 10 at intervals of approximately 120 degrees with the center of the base portion 10 as an axis. Note that, in the first embodiment, although an example in which the number of pillars is three is illustrated, the number of pillars may be not three as long as the pillars do not directly face one another. For example, if the number of pillars is an odd number, the pillars can maintain the relation of not directly facing one another also when the pillars are provided at substantially the same intervals with the center of the base portion 10 as an axis. Furthermore, one ends of the pillar 20, the pillar 30, and the pillar 40 are close to the base portion 10 but do not need to be physically connected to the base portion 10. For example, the pillar 20, the pillar 30, and the pillar 40 may be supported as the one ends are connected to the bottom frame 80 that is connected to the base portion 10, or may be supported by other members (for example, a supporting member 25 and the like illustrated in FIG. 2). That is, the pillar 20, the pillar 30, and the pillar 40 do not need to be supported by directly connected to the base portion 10 and may be supported in any way as long as being capable of retaining an arc shape while supporting the speakers 70.

Although the detail will be described later, the speakers 70 supported by the pillar 20, the pillar 30, and the pillar 40 are installed on each of the pillars such that the distances to a certain location that is located between the base portion 10 and the coupling portion 60 are substantially uniform. The certain location between the base portion 10 and the coupling portion 60 is a location based on microphones worn in the auricles of the user, for example, and more specifically, is the center point on the line connecting the two microphones worn in the auricles (hereinafter may be referred to as "measurement point"). Note that, in the present disclosure, the position of the speaker 70 is the center position of an output portion of the speaker 70 (for example, a speaker cone). Furthermore, the orientation of the speaker 70 is a direction in which the output portion of the speaker 70 (for example, a speaker cone) directly faces.

The speakers 70 provided on the pillars are installed such that each height from the base portion 10 is different. Specifically, the speakers 70 are installed so that each angle formed by the horizontal plane on which the base portion 10 is installed (in other words, a plane to be a reference such as the ground on which the measurement device 100 is installed) and a line connecting each speaker 70 and the measurement point is different.

Furthermore, because the pillar 20, the pillar 30, and the pillar 40 are in an arc shape, the speakers 70 supported on one pillar are installed at substantially the same distance with respect to the measurement point. As a result, the measurement device 100 can measure data of acoustic signals output from various angles with respect to the user at one time. Note that, in the following description, a plurality of speakers 70 may be described, but will be collectively referred to as "speaker 70" when individual speakers are not particularly distinguished.

The measurement device 100 further includes a chair 50 placed on the base portion 10. The chair 50 is located at the center of the three pillars and has a rotation mechanism rotatable in the horizontal direction with respect to the base portion 10. More specifically, the chair 50 is rotatable in the circumferential direction of a virtual axis connecting the base portion 10 and the coupling portion 60 (in other words, the base portion 10 and a measurement point P01 (certain location)). That is, the chair 50 may be rephrased as a rotation mechanism unit in the measurement device 100. At the time of measurement, the user wearing microphones in the auricles sits on the chair 50. That is, in the measurement device 100, the measurement point is placed on the rotation mechanism unit. Then, the measurement device 100, in accordance with the control of an administrator, operates the rotation mechanism of the chair 50 and makes the user go around once in the rotational direction while outputting acoustic signals from the speakers 70. This allows the measurement device 100 to acquire a large amount of measurement data in a short time without imposing a burden on the user.

Figure 2:
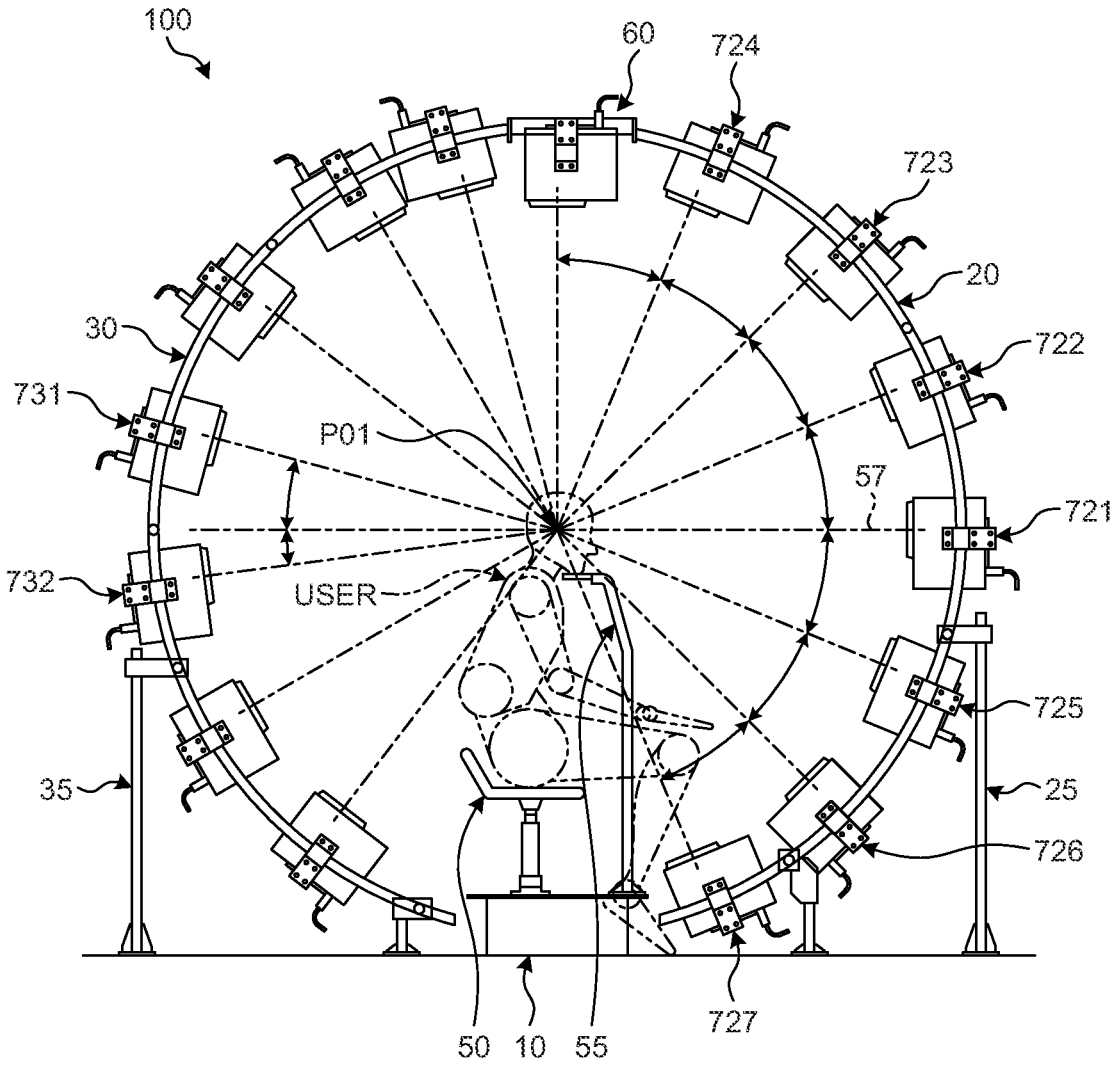
FIG. 2 is a cross-sectional view of the measurement device in the first embodiment of the present disclosure.

Next, by using FIG. 2, the cross section of the measurement device 100 will be described. FIG. 2 is a cross-sectional view of the measurement device in the first embodiment of the present disclosure. The left-and-right direction in FIG. 2 will be described as the horizontal direction, and the vertical direction in FIG. 2 will be described as a height direction.

Note that, in the following description, when referring to the height of the speaker 70 installed on each pillar, in principle, the height of the center position of the speaker cone is indicated. However, the height of the speaker 70 may employ any desired reference such as the height of the center of the housing of the speaker 70 or the lowermost or uppermost portion of the speaker 70.

In the example illustrated in FIG. 2, a state in which the user directly faces the pillar 20 is illustrated. The pillar 20 is supported by the supporting member 25 that is a member supporting the pillar 20. In the example of FIG. 2, the height of the measurement point P01 (user-worn microphones) is substantially the same as a speaker 721 that is one example of the speakers installed on the pillar 20. The user puts the jaw or the like on a fixing base 55, in order to prevent the height and position of the measurement point P01 from changing during the measurement, and stands by. In FIG. 2, the height of the measurement point P01 is indicated by a horizontal line 57. Note that, although the depiction in FIG. 2 is omitted, the measurement device 100 may, in order to stabilize the posture of the user, be provided with an irradiation mechanism of laser (laser output unit) indicating the horizontal line 57 for guiding the line of vision of the user. Furthermore, in FIG. 2, only one measurement point P01 is depicted for the purpose of simplifying the explanation, but to be precise, the measurement points P01 are two points in the auricles of the user.

As illustrated in FIG. 2, a speaker 722 installed one above the speaker 721, out of the speakers installed on the pillar 20, is installed at an angle obtained, in an arc formed by the pillar 20, by dividing the rotation angle (180 degrees) by the number obtained by adding 1 to the number of installed speakers, for example. In the example in FIG. 2, except for the portions directly above and below the measurement point P01, seven speakers are installed on the pillar 20. Thus, the speaker 722 is installed such that the angle in the height direction with respect to the measurement point P01 is "22.5 degrees". Similarly, a speaker 723 is installed upward by "22.5 degrees" from the angle at which the speaker 722 is installed. In other words, the speaker 723 is installed such that the angle in the height direction with respect to the measurement point P01 is "45 degrees". Similarly, a speaker 724 is installed upward by "22.5 degrees" from the angle at which the speaker 723 is installed. In other words, the speaker 724 is installed such that the angle in the height direction with respect to the measurement point P01 is "67.5 degrees".

Furthermore, out of the speakers installed on the pillar 20, a speaker 725 installed one below the speaker 721 is installed such that, with the angle formed by the speaker 721 and the measurement point P01 as a reference, the angle in the height direction with respect to the measurement point P01 is "minus 22.5 degrees". Similarly, a speaker 726 is installed downward by "22.5 degrees" from the angle at which the speaker 725 is installed. In other words, the speaker 726 is installed such that the angle in the height direction with respect to the measurement point P01 is "minus 45 degrees". Similarly, a speaker 727 is installed downward by "22.5 degrees" from the angle at which the speaker 726 is installed. In other words, the speaker 727 is installed such that the angle in the height direction with respect to the measurement point P01 is "minus 67.5 degrees".

Furthermore, as in the foregoing, on the pillar 20 and the pillar 30, the speakers are installed at different angles with respect to the horizontal line 57. This is to measure, at the time of measurement, in one measurement, data concerning acoustic signals output from more angles.

For example, the speakers installed on the respective pillars are installed at intervals at which the angle of speakers installed on one pillar is divided into three equal parts. As in the foregoing, in the first embodiment, because the angle of the speakers installed on one pillar is "22.5 degrees", the speakers installed on the respective pillars are installed staggering from each other for each "7.5 degrees". Note that, the reason why a large number of speakers are not installed for each "7.5 degrees" on a single pillar is to ensure installation intervals of speakers that are likely to be relatively large. That is because, if a large number of speakers are installed for each "7.5 degrees" on a single pillar, the diameter of the speaker cone becomes small, and that makes it impossible to output an acoustic signal of wide frequencies.

For the above-described reasons, in the example illustrated in FIG. 2, a speaker 732 that is an example of the speakers installed on the pillar 30 (similar to the pillar 20, supported by a supporting member 35) is installed at an angle of "minus 7.5 degrees" with respect to the horizontal line 57 indicating the height of the measurement point P01. In other words, the speaker 732 can output an acoustic signal to the measurement point P01 from an angle shifted by "minus 7.5 degrees" with respect to the speaker 721 on the pillar 20. Furthermore, out of the speakers installed on the pillar 30, a speaker 731 installed one above the speaker 732 is installed at an angle of "22.5 degrees" from the speaker 732, in other words, "15 degrees" from the horizontal line 57. The other speakers installed on the pillar 30 are also installed in the same manner as the above-described relation between the speaker 731 and the speaker 732. Furthermore, although the depiction in FIG. 2 is omitted, the speakers installed on the pillar 40 are also installed in the same manner as the above-described relation.

As in the foregoing, a plurality of speakers 70 are installed such that each of the angles formed by a certain reference line and the lines connecting the speakers 70 installed on a first pillar (for example, the pillar 20) out of a plurality of pillars and the measurement point P01 is different from each of the angles formed by the certain reference line and the lines connecting the speakers 70 installed on a second pillar (for example, the pillar 30) and the measurement point P01. Specifically, the speakers 70 are installed such that each of the angles formed by the line extending the measurement point P01 in the horizontal direction (the horizontal line 57 in the example of FIG. 2) and the lines connecting the respective speakers 70 and the measurement point P01 is different and each of the speakers 70 is at an angle of substantially equal intervals ("7.5 degrees" in the example of FIG. 2).

With such a configuration, the measurement device 100 can output acoustic signals including a wide frequency band at an angle of 7.5 degrees each in the height direction to the measurement point P01 at one time. Note that, as in the foregoing, when the angle of the speakers 70 installed on one pillar in the height direction with respect to the measurement point P01 is "22.5 degrees", it may be not possible to ensure an angle of "22.5 degrees" at portions near the upper or lower side of the measurement point P01. In this case, various adjustments may be made, such as reducing the number of speakers installed on one pillar, narrowing the installation angle, and the like.

Figure 3:
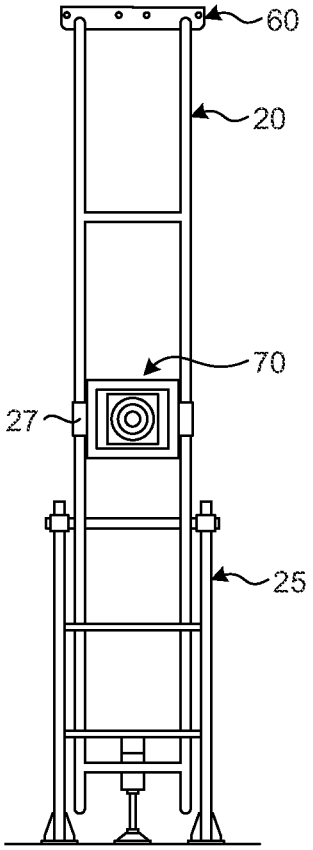
FIG. 3 is a front view of a pillar provided in the measurement device in the first embodiment of the present disclosure.

Subsequently, by using FIG. 3, the structure of the pillar 20 will be described. FIG. 3 is a front view of the pillar 20 provided in the measurement device 100 in the first embodiment of the present disclosure. Note that, although the depiction is omitted in FIG. 3, the pillar 30 and the pillar 40 also have the same structure as that of the pillar 20. Furthermore, in FIG. 3, the depiction is simplified and only one speaker 70 is illustrated for the purpose of explaining the pillar 20, but to be precise, as described with FIG. 2, a plurality of speakers 70 are installed on the pillar 20.

The pillar 20 is placed on the base portion 10 by the bottom portion thereof, extends upward in an arc shape, and is coupled to the other pillar 30 and the pillar 40 via the coupling portion 60. Furthermore, the pillar 20 is supported by the supporting member 25.

The pillar 20 includes an installation mechanism 27 that makes the speaker 70 movable. The installation mechanism 27 includes screw holes and the like to screw the speaker 70, for example, and the speaker 70 can be installed. For example, the installation mechanism 27 includes a mechanism that slides inside of the pillar 20 like a rail. For example, the installation mechanism 27 is divided into the number of speakers installed on the pillar 20 and is in a structure that allows sliding of a certain range of angles (for example, 22.5 degrees with respect to the horizontal line 57 illustrated in FIG. 2). As a result, the administrator of the measurement device 100 can move each of the speakers 70 and finely adjust the angle, even after installation of the speakers 70. Note that, the installation mechanism 27 may be a mechanism that uniformly slides all the speakers 70 installed on the pillar 20. Furthermore, the installation mechanism 27 may include a circuit or the like that implements control by software or the like. As a result, the administrator of the measurement device 100 can arbitrarily adjust the installation angle of the speaker 70 by the software or the like without touching it. As for the structure of the above-described slide mechanism, various known structures may be employed.

Figure 4:
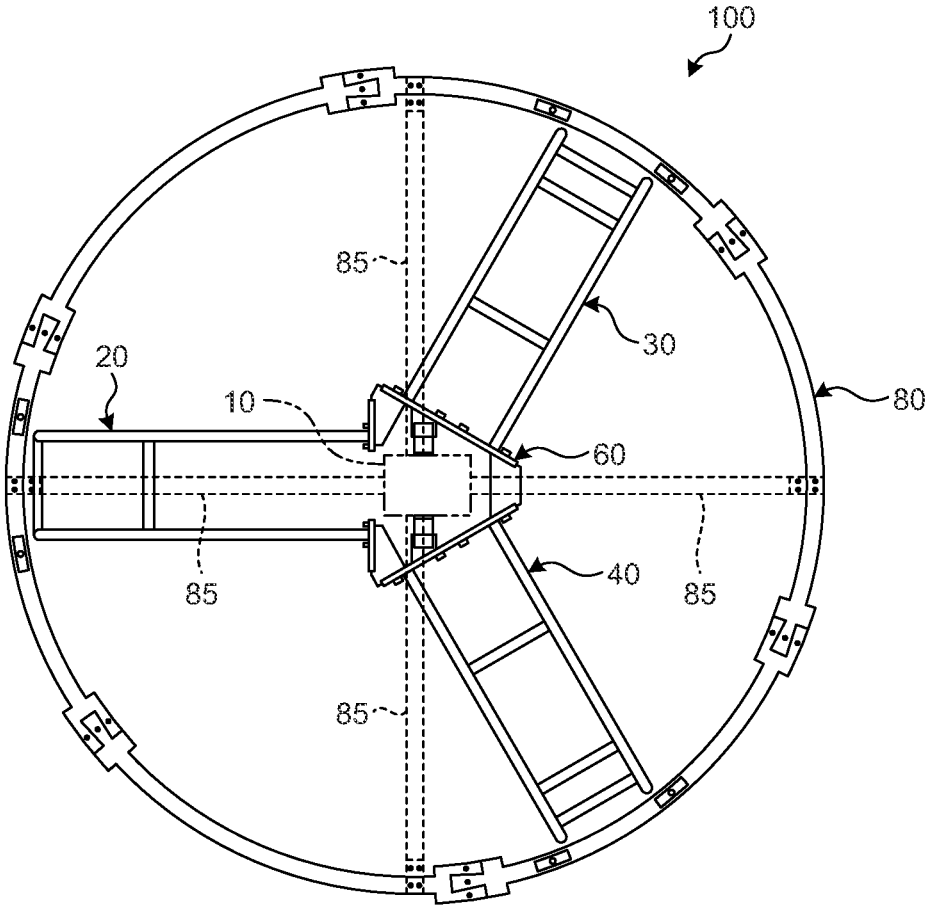
FIG. 4 is a plan view of the measurement device in the first embodiment of the present disclosure.

Subsequently, by using FIG. 4, the planar structure of the measurement device 100 will be described. FIG. 4 is a plan view of the measurement device 100 in the first embodiment of the present disclosure.

As illustrated in FIG. 4, the measurement device 100 includes the bottom frame 80. The measurement device 100 further includes three pillars at substantially equal intervals in the rotational direction with the center of the measurement device 100 as an axis. The pillar 20, the pillar 30, and the pillar 40 are coupled by the coupling portion 60. As a result, because the pillar 20, the pillar 30, and the pillar 40 are supported in an arch-like structure, they can be self-supported even if there is no supporting member at the portion directly below the coupling portion 60 (the place where the user is located at the time of measurement). Furthermore, as illustrated in FIG. 4, the base portion 10 and the bottom frame 80 may be connected to each other by a plurality of supporting members. For example, the measurement device 100 is provided with connecting frames 85 for which one end is connected to the base portion 10. The connecting frames 85 extend the other ends in the vertical or horizontal direction when the base portion 10 is seen from the upper surface, and each of the other ends is coupled to the bottom frame 80. As a result, the measurement device 100 can enhance the rigidity. Note that, in the following description, the bottom frame 80, the connecting frames 85, the supporting member 25, and the like may be collectively referred to simply as "frame". That is, the three pillars provided in the measurement device 100 are self-supported as they are connected to the frame and are coupled at the coupling portion 60 at the upper portion.

Furthermore, as apparent from FIG. 4, the measurement device 100 has a structure in which the three pillars do not directly face one another. For example, the pillar 20 (more specifically, acoustic output planes of the speakers 70 installed on the pillar 20) neither directly face the pillar 30 nor the pillar 40. Note that, a state in which a plurality of pillars directly face one another is that, when the measurement device 100 is viewed from the upper surface, the pillar 20, the pillar 30, and the pillar 40 are located on the same line (when each is regarded as a line, each line does not intersect and forms one straight line).

When the three pillars do not directly face one another, the acoustic signals output from the speakers 70 installed on the pillar 20 are not likely to be affected by the reflection from the pillar 30 or the pillar 40. This also applies to the speakers 70 installed on the pillar 30 and the pillar 40. This allows the measurement device 100 to acquire measurement data that is less affected by the reflection at the measurement point P01.

Figure 5:
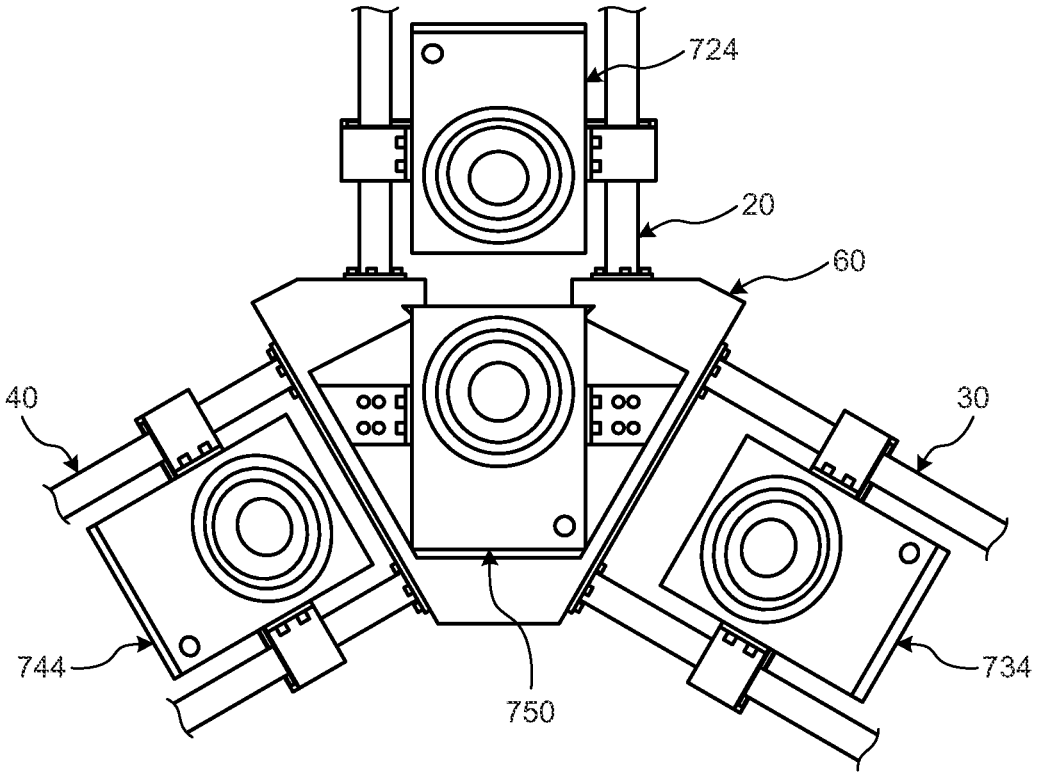
FIG. 5 is a diagram illustrating a coupling portion of the measurement device in the first embodiment of the present disclosure.

Subsequently, by using FIG. 5, the structure of the coupling portion 60 provided in the measurement device 100 will be described. FIG. 5 is a diagram illustrating the coupling portion 60 of the measurement device 100 in the first embodiment of the present disclosure. FIG. 5 illustrates the structure of the coupling portion 60 when the coupling portion 60 is looked up from the center of the base portion 10.

Figure 6:
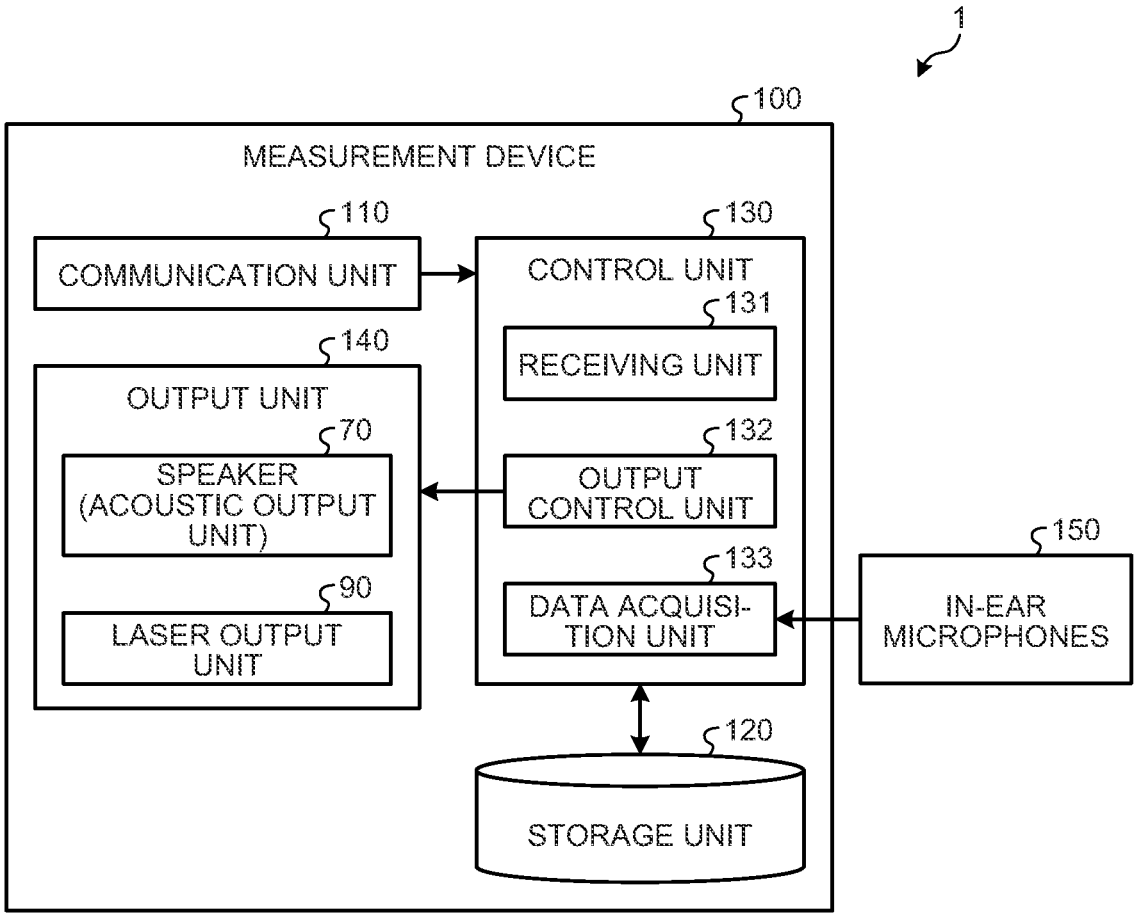
FIG. 6 is a diagram illustrating a configuration example of a measurement system in the first embodiment of the present disclosure.

As illustrated in FIG. 6, the coupling portion 60 has a triangular frame and has a structure in which a pillar is coupled to each of the sides of the triangle. That is, the coupling portion 60 couples the pillar 20, the pillar 30, and the pillar 40 at the portion directly above the base portion 10. In the example of FIG. 6, on the pillar 20, the speaker 724 that is installed at the uppermost portion of the pillar 20 is installed, on the pillar 30, a speaker 734 that is installed at the uppermost portion of the pillar 30 is installed, and on the pillar 40, a speaker 744 that is installed at the uppermost portion of the pillar 40 is installed. Then, at the center of the coupling portion 60, a speaker 750 is installed. The speaker 750 is installed directly above the center of the base portion 10, that is, directly above the measurement point P01.

As just described, because the coupling portion 60 couples the three pillars and forms an arch-like ceiling structure, the measurement device 100 can retain a stable shape without installing a supporting member directly below the measurement point P01. In addition, on the coupling portion 60, because the speaker 750 located directly above the measurement point P01 can be installed, the measurement device 100 can also acquire the measurement data concerning the acoustic signal from directly above the measurement point P01 easily.

1-2. Configuration of Measurement Device in First Embodiment

Next, by using FIG. 6, the configuration of a measurement system 1 in the present disclosure including the measurement device 100 and the internal configuration of the measurement device 100 will be described. FIG. 6 is a diagram illustrating a configuration example of the measurement system 1 in the first embodiment of the present disclosure. The measurement system 1 includes the measurement device 100 and in-ear microphones 150 worn in the auricles of the user.

As illustrated in FIG. 6, the measurement device 100 includes a communication unit 110, a storage unit 120, a control unit 130, and an output unit 140.

The communication unit 110 is implemented by a network interface card (NIC) or the like, for example. The communication unit 110 is connected to a network (such as the Internet) in a wired or wireless manner, and via the network, performs transmitting and receiving of information with a certain external device and the like. For example, the communication unit 110 receives setting information and the like concerning the measurement, from a terminal device or the like that the administrator of the measurement device 100 uses.

The control unit 130 is implemented, for example, by a central processing unit (CPU), a micro-processing unit (MPU), or the like, by executing a computer program stored inside of the measurement device 100 with a random access memory (RAM) and the like as a work area. Furthermore, the control unit 130 is a controller and may be implemented by an integrated circuit such as an application specific integrated circuit (ASIC) and a field programmable gate array (FPGA), for example.

As illustrated in FIG. 6, the control unit 130 includes a receiving unit 131, an output control unit 132, and a data acquisition unit 133, and implements or executes the functions and operations of information processing described in the following. Note that, the internal configuration of the control unit 130 is not limited to the configuration illustrated in FIG. 6, and may be in other configurations as long as it is the configuration that performs the information processing which will be described later.

The receiving unit 131 receives setting information concerning the measurement. For example, the receiving unit 131 receives a type of acoustic signal used for the measurement, a signal for starting the measurement, and the like, from the administrator and the like of the measurement device 100. Furthermore, the receiving unit 131 may receive attribute information on the user who sits on the chair 50. For example, the receiving unit 131 receives information such as the height, weight, and gender of the user.

The output control unit 132 controls the output of various signals. For example, the output control unit 132 controls the timing, volume, and the like of the acoustic signals output from the speakers 70. The output control unit 132 further controls the output of a laser that is a guide of the line of vision of the user.

The output control unit 132 further outputs a signal to control the operation of the rotation mechanism. For example, the output control unit 132 outputs a signal that controls the timing, speed, and the like of the rotation of the chair 50. For example, while outputting acoustic signals from the speakers 70 installed on each pillar, the chair 50 is controlled so as to be rotated by 360 degrees within a certain time.

For example, the output control unit 132 controls, based on the setting information received in advance by the receiving unit 131, the speed at which the chair 50 is rotated. In this case, the setting information is the measurement resolution that the administrator of the measurement device 100 requests, for example, and specifically, is indicated by the number and angle of points (locations) to measure the measurement data.

For example, the administrator of the measurement device 100 inputs, to the measurement device 100, the information that set at what density the measurement is performed. As one example, the administrator of the measurement device 100 inputs the setting information that performs the measurement of acoustic signals for each rotation angle of "7.5 degrees". In this case, the output control unit 132 controls the chair 50 so as to be rotated at a speed that allows the measurement data to be obtained for each rotation angle of 7.5 degrees.

The data acquisition unit 133 acquires measurement data. For example, the data acquisition unit 133 acquires information concerning the acoustic signals measured at the measurement point P01, via the in-ear microphones 150 worn in the auricles of the user. The data acquisition unit 133 stores the acquired data in the storage unit 120.

The data acquisition unit 133 acquires the measurement data corresponding to the user, by combining the measurement data acquired from the speakers 70 installed on the three pillars and installed directly above the measurement point P01. For example, the data acquisition unit 133 can acquire the measurement data corresponding to the requested resolution, as the rotation of the chair 50 is controlled according to the resolution set in advance.

The data acquisition unit 133 can acquire, in a single measurement, a plurality of measurement data corresponding to the acoustic signals output from the speakers 70 that are installed on the three pillars placed for each rotation angle of 120 degrees and are installed for each height of 7.5 degrees. This allows the data acquisition unit 133 to acquire the measurement data of high density (that is, with relatively many measurement points) efficiently in a short time.

Figure 7A:
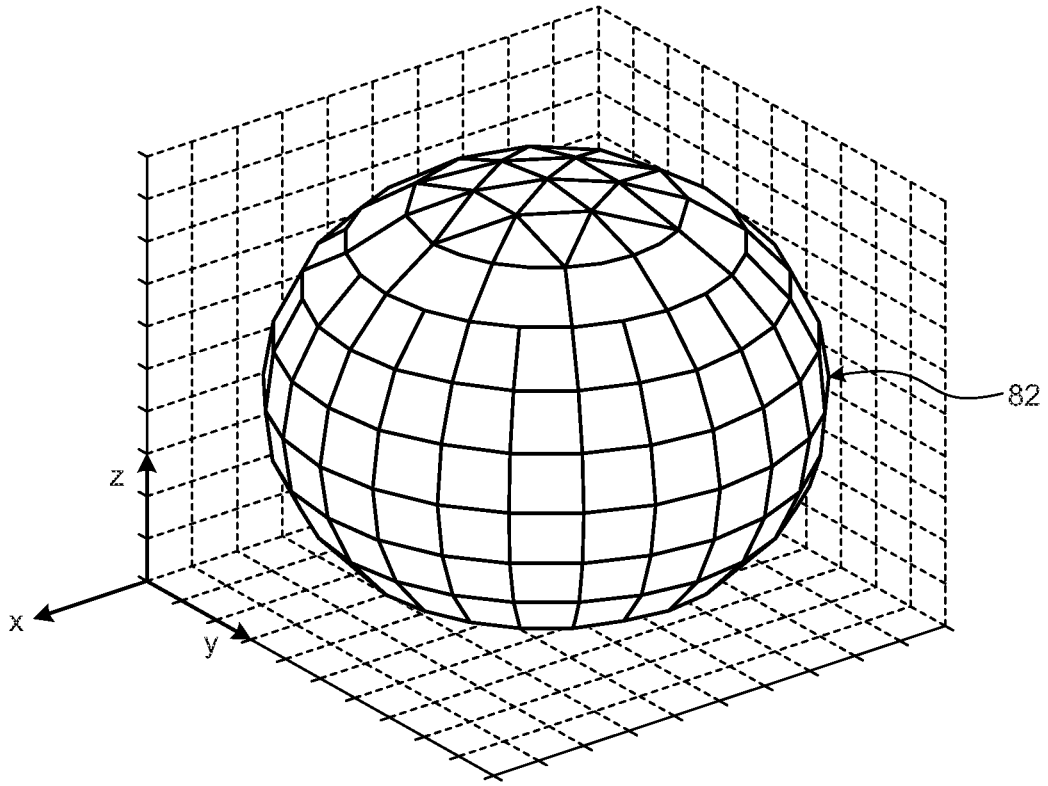
FIG. 7A is an image diagram (1) illustrating points that the measurement device of the present disclosure measures.
Figure 7B:
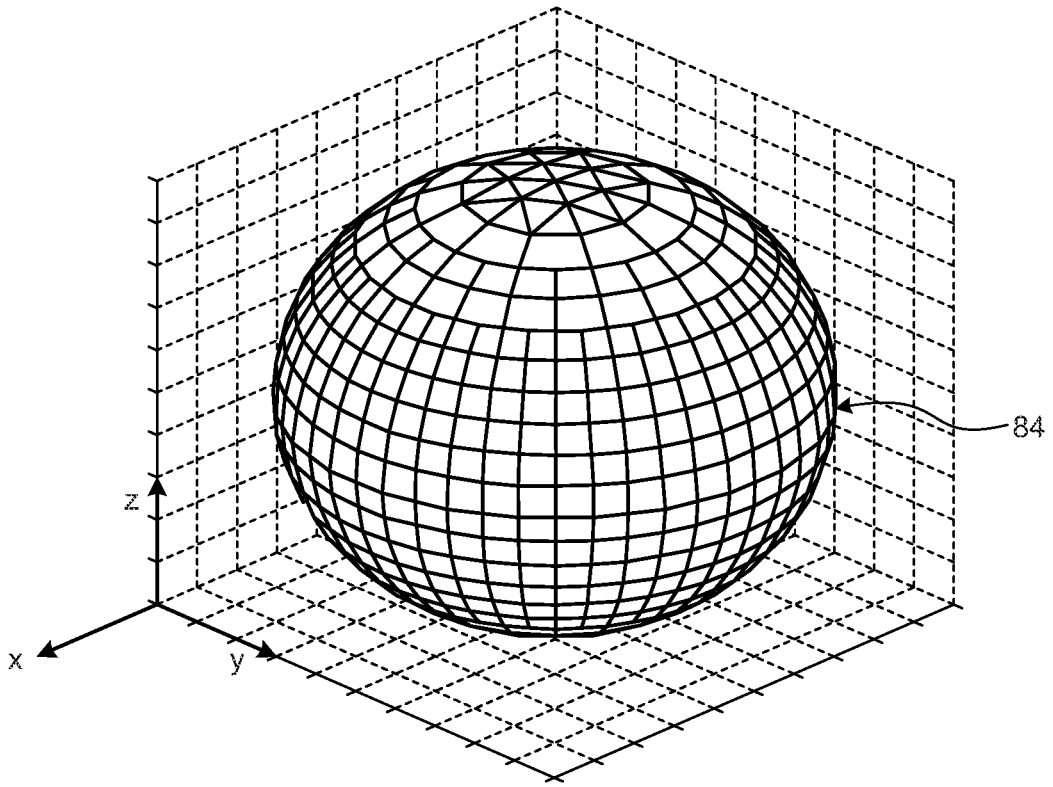
FIG. 7B is an image diagram (2) illustrating the points that the measurement device of the present disclosure measures.
Figure 7C:
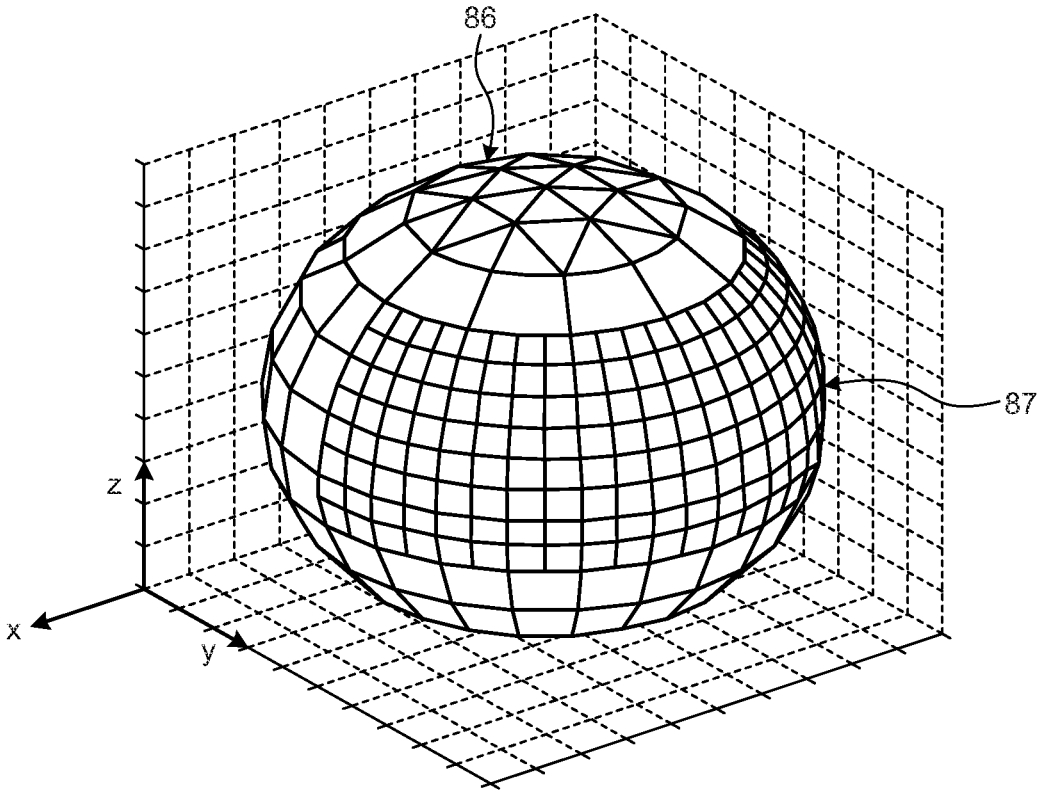
FIG. 7C is an image diagram (3) illustrating the points that the measurement device of the present disclosure measures.

Herein, the points that the measurement device 100 measures will be conceptually described by using FIGS. 7A, 7B, and 7C. FIG. 7A is an image diagram (1) illustrating the points that the measurement device 100 of the present disclosure measures.

FIG. 7A illustrates a sphere 82 schematically representing the points that the measurement device 100 measures. The sphere 82 is composed of three-dimensional elements (coordinates) of the x-axis, the y-axis, and the z-axis. In the sphere 82, with the measurement point P01 as the center point, the intersection of each of the lines constituting the sphere 82 indicates the point of measurement. As in the foregoing, the measurement device 100 can perform, by installing the speakers 70 at alternating angles, in one measurement (measurement when the user is rotated by 360 degrees), the measurement of points indicated as a grid in FIG. 7A.

FIG. 7B is an image diagram (2) illustrating the points that the measurement device 100 of the present disclosure measures. FIG. 7B has a dense grid as compared with FIG. 7A. That is, FIG. 7B indicates that there are many points as compared with FIG. 7A. For example, FIG. 7B indicates a state in which more points are measured, as compared with FIG. 7A, in order to obtain a more accurate head-related transfer function. In this case, the measurement device 100 can, by doubling the resolution concerning the rotational direction and, after finishing the measurement at the points indicated in FIG. 7A, performing the measurement again by changing the installation of the speakers 70 (for example, such as moving them upward or downward by 3.75 degrees each), obtain the measurement data at the points indicated in FIG. 7B.

For example, when the number of points as indicated in FIG. 7B is an ideal situation for obtaining an appropriate head-related transfer function, the measurement device 100 can increase the measurement data by increasing the number of times of measurement as in the foregoing, or increasing the resolution.

Moreover, the measurement device 100 can also employ the points as in FIG. 7C in order to terminate the measurement in a short time and to obtain an ideal head-related transfer function. FIG. 7C is an image diagram (3) illustrating the points that the measurement device 100 of the present disclosure measures.

In the example illustrated in FIG. 7C, only a region 87 is a dense region and other regions are the same as those points of FIG. 7A. This is because the human sense of sound directivity is sensitive to the front. That is, the measurement device 100 can obtain a necessary and sufficiently head-related transfer function if the measurement is performed densely as illustrated in FIG. 7C within only a certain angle from the horizontal direction of the line of vision of the user, even though the entire region is not densely measured as illustrated in FIG. 7B.

In this case, the measurement device 100 may install slightly densely the speakers 70 installed within a certain angle from the horizontal direction of the line of vision of the user and may install slightly sparsely the speakers 70 located above or below the certain angle, for example. Specifically, the measurement device 100 installs the speakers 70 that are installed on one pillar within a certain angle from the horizontal direction of the line of vision of the user at the intervals of not the above-described "22.5 degrees" but "20 degrees", and installs the speakers 70 that are located above and below the certain angle at not "22.5 degrees" but "25 degrees". As just described, the measurement device 100 can acquire useful data in a short time, by appropriately changing the installation locations of the speakers 70 and the resolution according to the human sensibility, without significantly increasing the number of times of the measurement in order to measure the points illustrated in FIG. 7B.

The storage unit 120 is implemented by a semiconductor memory device such as a random-access memory (RAM) and a flash memory or by a storage device such as a hard disk and an optical disc, for example.

The storage unit 120 stores therein various information. For example, the storage unit 120 stores therein a sound source (for example, a sweep signal and the like covering the frequencies in a human audible range) of the acoustic signals output in the measurement. The storage unit 120 further stores therein the measurement data acquired by the data acquisition unit 133. At this time, the storage unit 120 may store the measurement data related to the user together with the attribute information of the relevant user.

The output unit 140 outputs various information according to the control by the output control unit 132. The speaker (acoustic output unit) 70 outputs the acoustic signal used for the measurement. A laser output unit 90 outputs a laser to be a guide indicating the reference of the line of vision of the user. For example, the laser output unit 90 is provided on the fixing base 55 and outputs a laser indicating the line-of-sight direction of the user or the horizontal line 57. Note that, the guide is not limited to the laser and may be any display body as long as it is capable of displaying the horizontal line 57 and the like.

1-3. Procedure of Information Processing in First Embodiment

Figure 8:
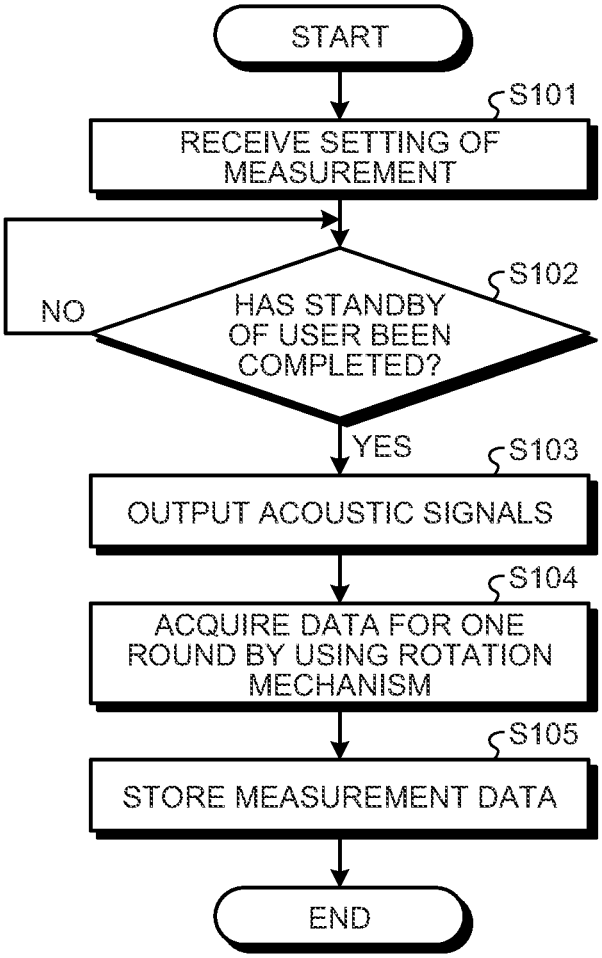
FIG. 8 is a flowchart illustrating a flow of processing in the first embodiment of the present disclosure.

Next, by using FIG. 8, the procedure of information processing in the first embodiment will be described. FIG. 8 is a flowchart illustrating the flow of processing in the first embodiment of the present disclosure.

As illustrated in FIG. 8, the measurement device 100 receives the setting of measurement from the administrator and the like of the measurement device 100 (Step S101). Thereafter, the measurement device 100 determines whether the information about having completed the standby of the user has been received (Step S102). If the information about having completed the standby of the user has not been received (No at Step S102), the measurement device 100 waits until it is received.

Meanwhile, if the information about having completed the standby of the user has been received (Yes at Step S102), the measurement device 100 controls the speakers 70 and starts outputting the acoustic signals (Step S103).

Then, the measurement device 100 rotates, according to the received setting, the user by 360 degrees by using the rotation mechanism provided on the chair 50 and acquires the measurement data for one round (Step S104). The measurement device 100 stores the measurement data for one round (Step S105) and completes the measurement.

2. Second Embodiment

Next, a second embodiment will be described. In the first embodiment, an example in which the measurement device 100 acquires the measurement data that is recorded by the in-ear microphones 150 worn in the auricles of the user has been illustrated. The measurement device 100 may be used not only for the application of measuring the user's own head-related transfer function but also for other applications.

Figure 9:
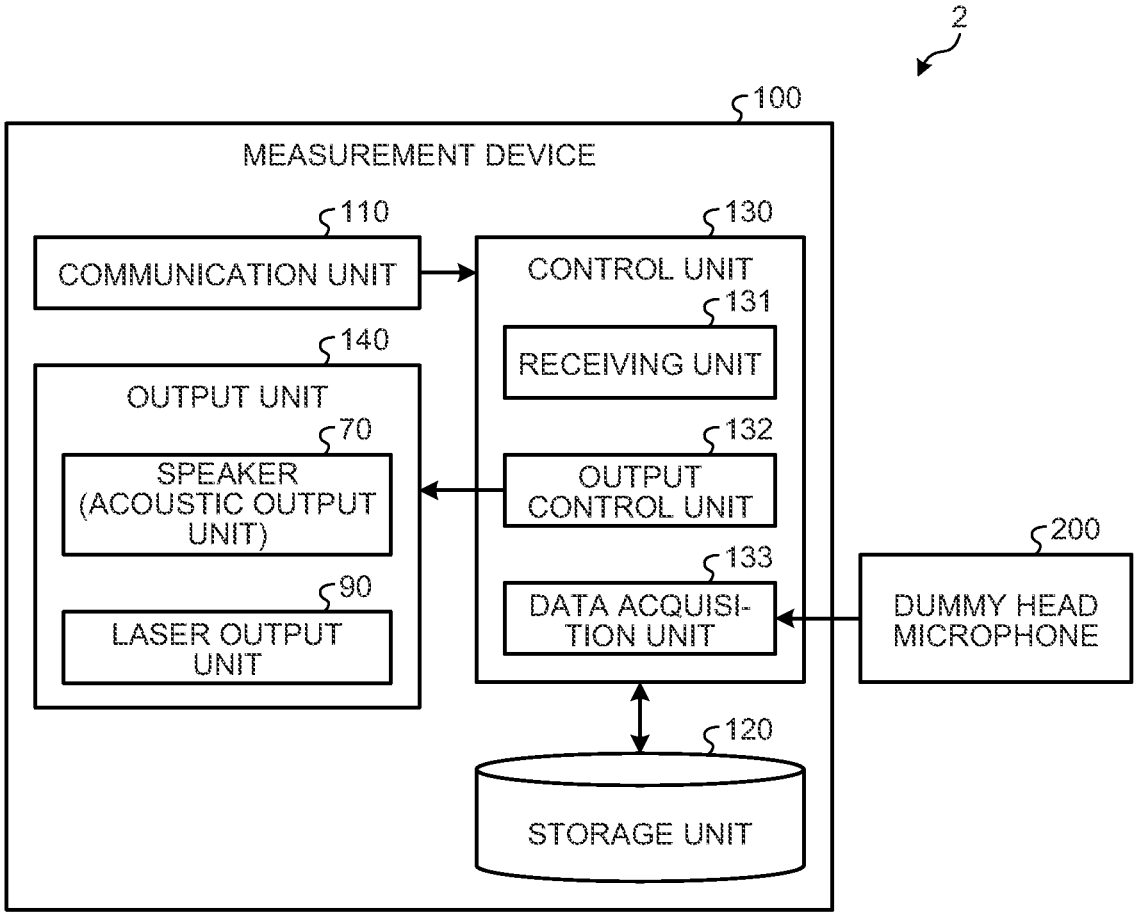
FIG. 9 is a diagram illustrating a configuration example of a measurement system according to a second embodiment of the present disclosure.

This point will be described by using FIG. 9. FIG. 9 is a diagram illustrating a configuration example of a measurement system 2 according to the second embodiment. The measurement system 2 includes the measurement device 100 and a dummy head microphone 200.

The measurement device 100 has the configuration the same as that of the first embodiment. The dummy head microphone 200 is a microphone installed at the center of the measurement device 100 in place of the user (in other words, the in-ear microphones 150) in the first embodiment. The dummy head microphone 200 is composed of a dummy head having a shape imitating a human head and microphones installed inside of the auricles of the dummy head.

The measurement device 100, as with the first embodiment, outputs acoustic signals to the dummy head microphone 200 and acquires measurement data for obtaining a head-related transfer function concerning the dummy head.

As just described, the measurement system 2 in the present disclosure may be in a configuration in which the dummy head microphone 200 is installed in place of the user. Even with such a configuration, as with the first embodiment, the measurement system 2 is less likely to be affected by the reflection and able to acquire the measurement data by the acoustic signals of a wide frequency range. Note that, the dummy head microphone 200 can be replaced with microphones of various shapes as long as it is the microphone capable of acquiring sound data without having the shape of a dummy head. That is, according to the measurement system 1 and the measurement system 2 in the present disclosure, the appropriate measurement data can be acquired efficiently regardless of the measurement target being a user or a dummy head.

3. Other Embodiments

The processing in each of the above-described embodiments may be implemented in various different modes in addition to each of the above-described embodiments.

For example, in the above-described first embodiment, although the configuration in which the measurement device 100 is equipped with three pillars has been described, the number of pillars is not limited thereto. That is, because the measurement device 100 can perform the measurement in a short time while suppressing the influence of reflection by being provided with a plurality of pillars that do not directly face, it does not necessarily need to set three pillars. Furthermore, the measurement device 100 may include three or more pillars as long as they are not in a relation of directly facing one another. Furthermore, in the above-described first embodiment, an example in which three pillars are close to the base portion 10 but not directly connected to has been illustrated. However, the three pillars may be directly connected to the base portion 10. That is, the three pillars may be connected to the base portion 10 directly, or to the base portion 10 indirectly via various members coupling to the base portion 10 (for example, the bottom frame 80, the connecting frames 85, the supporting member 25, and the like) as inclusions. Furthermore, the three pillars do not necessarily need to be coupled by the coupling portion 60, and each pillar may be self-supported regardless of the coupling portion 60.

Furthermore, the measurement device 100 may be not provided with the rotation mechanism on the chair 50 but provided with the rotation mechanism on the base portion 10. In this case, the base portion 10 can be rotated in a circumferential direction of an axis connecting the base portion 10 and the measurement point P01, and a plurality of pillars are provided to be rotatable in the circumferential direction around the measurement point P01 while retaining the distance between the speaker 70 and the measurement point P01 substantially uniform. Note that, the measurement device 100 may be provided with the rotation mechanism on the bottom frame 80. As just described, by having a configuration in which the pillar side is rotated, the measurement can be performed while the user is stationary, and thus the burden on the user in the measurement can be reduced.

The measurement device 100 may include the speakers 70 of seven or more or seven or less on one pillar. That is, the measurement device 100 may change the configuration variously depending on the density of the measurement data needed.

The measurement device 100 may perform a certain weighting on the measurement data. As in the foregoing, due to the characteristics of human hearing, humans are sensitive to a front sound source within a certain angle in the height direction such as within a viewing angle. Thus, the measurement device 100 can, by performing a certain weighting on the data measured within the above-described certain range, acquire pseudo measurement data corresponding to the human characteristics as illustrated in FIG. 7C.

Furthermore, the measurement device 100 may arrange the speakers 70 to be able to measure dense data, by controlling the slide mechanisms of the speakers 70 so as to install the speakers 70 densely, coinciding with the timing of acquiring the measurement data of the front of the user, for example. That is, the measurement device 100 may obtain, by controlling the motion of the speakers 70, the measurement data illustrated in FIG. 7C by software control without moving the speakers 70 artificially. As a result, the measurement device 100 can perform the measurement more efficiently.

Furthermore, the measurement device 100 may configure the speakers 70 installed at places near the viewing angle of the user to be double cones and the like, for example. In this case, the speakers 70 are installed sideways so that the cones are both installed on the outside of the pillar. As a result, the measurement device 100 can easily increase the number of sound sources outputting acoustic signals near the viewing angle of the user, so that the measurement data as illustrated in FIG. 7C can be easily acquired.

Furthermore, in the above-described first embodiment, an example in which the speakers 70 installed on the three pillars are shifted from one another in angles in the height direction has been illustrated. The speakers 70 installed on the three pillars may be installed at the same angle. In this case, the measurement device 100 can acquire the measurement data for one round, by merely rotating the rotation mechanism by only 120 degrees, although the measurement data in the height direction is sparse. Thus, the measurement device 100 can significantly shorten the measurement time.

Furthermore, the measurement device 100 may install microphones, not installing the speakers 70, on the three pillars. In this case, the measurement system 1 does not include the user (the in-ear microphones 150) or the dummy head microphone 200 at a certain location but includes an acoustic output device (for example, the speaker 70). The measurement device 100 then outputs an acoustic signal from the acoustic output device and acquires measurement data with a plurality of microphones installed on the pillars. As a result, the measurement device 100 can acquire the measurement data such as how the acoustic signal output from the sound source radiates, in an environment less affected by reflection and in a short time. As just described, the structure of the measurement device 100 illustrated in FIG. 1 and FIG. 2 is applicable to not only the measurement data of a head-related transfer function but also various measurements.

Furthermore, out of each processing described in each of the above-described embodiments, all or a part of the processing described to be performed automatically can be performed manually, or all or a part of the processing described to be performed manually can be performed automatically in a known method. In addition, the processing procedures, specific names, and information including various data and parameters illustrated in the document and drawings can be changed arbitrarily except where noted. For example, the various information illustrated in each drawing is not limited to the illustrated information.

Furthermore, the respective constituent elements of the various devices illustrated are functionally conceptual, and do not necessarily need to be physically configured as illustrated in the drawings. In other words, the specific embodiments of distribution or integration of the various devices are not limited to those illustrated, and the whole or a part thereof can be configured by being functionally or physically distributed or integrated in any unit, according to various types of loads and usage. For example, the output control unit 132 and the data acquisition unit 133 illustrated in FIG. 6 may be integrated.

In addition, each of the above-described embodiments and modifications can be combined as appropriate within a scope of not making the processing details inconsistent.

Furthermore, the effects described herein are merely examples and not intended to be limited, and other effects may be obtained.

4. Hardware Configuration

Figure 10:
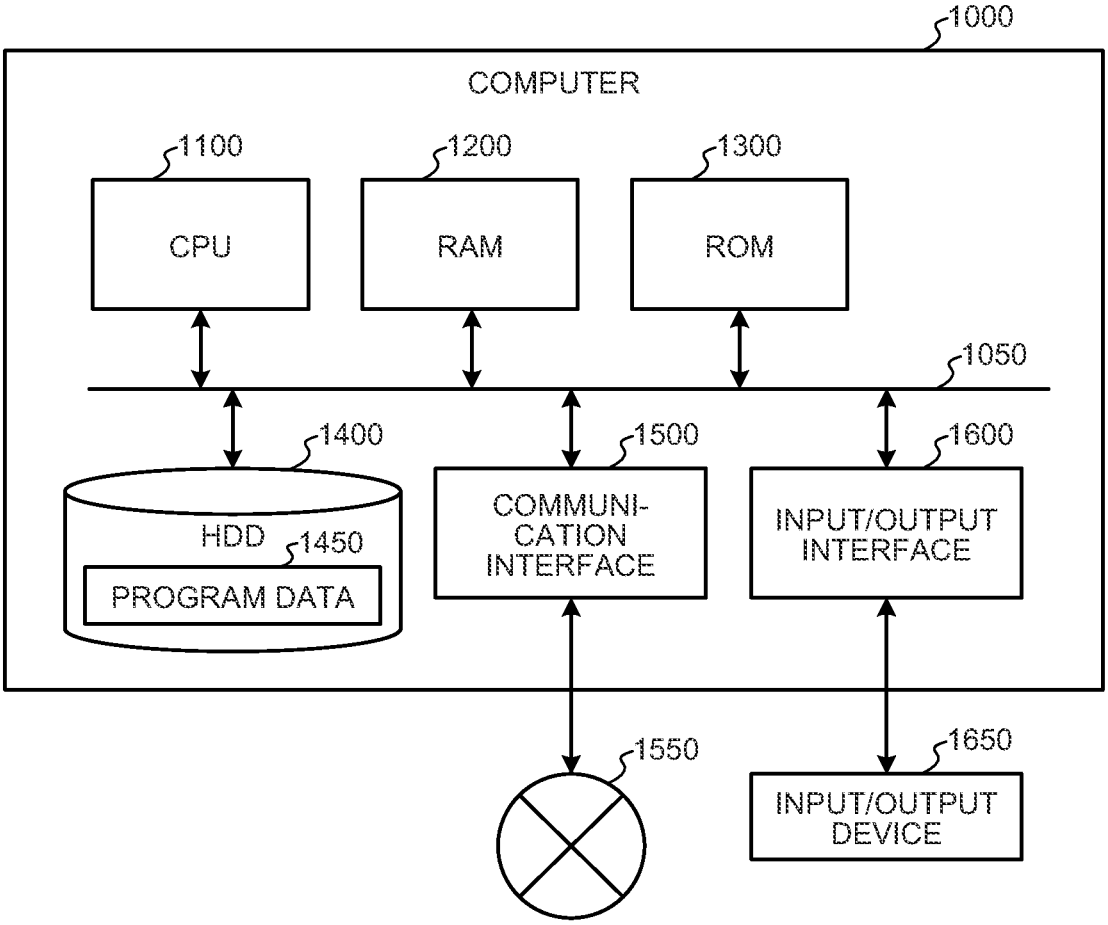
FIG. 10 is a hardware configuration diagram illustrating one example of a computer that implements functions of the measurement device.

Out of the measurement device 100 in each of the above-described embodiments, the internal components including the control unit 130 and the like are implemented by a computer 1000 configured as illustrated in FIG. 10, for example. In the following description, the measurement device 100 in the first embodiment will be described as an example. FIG. 10 is a hardware configuration diagram illustrating one example of the computer 1000 that implements the functions of the measurement device 100. The computer 1000 includes a CPU 1100, a RAM 1200, a read only memory (ROM) 1300, a hard disk drive (HDD) 1400, a communication interface 1500, and an input/output interface 1600. Various units of the computer 1000 are connected via a bus 1050.

The CPU 1100 operates based on computer programs stored in the ROM 1300 or the HDD 1400 and controls various units. For example, the CPU 1100 loads the computer programs stored in the ROM 1300 or the HDD 1400 into the RAM 1200 and executes the processing corresponding to the various computer programs.

The ROM 1300 stores therein a boot program such as a basic input output system (BIOS) that is executed by the CPU 1100 at the time of starting up the computer 1000 and computer programs and the like that depend on the hardware of the computer 1000.

The HDD 1400 is a computer-readable recording medium that records the computer programs executed by the CPU 1100 and data and the like used by such computer programs in a non-transitory manner. Specifically, the HDD 1400 is a recording medium that records an information processing program in the present disclosure that is one example of program data 1450.

The communication interface 1500 is an interface for the computer 1000 to connect to an external network 1550 (for example, the Internet). For example, via the communication interface 1500, the CPU 1100 receives data from other devices or transmits data generated by the CPU 1100 to the other devices.

The input/output interface 1600 is an interface for connecting an input/output device 1650 and the computer 1000. For example, via the input/output interface 1600, the CPU 1100 receives data from an input device such as a keyboard and a mouse. The CPU 1100, via the input/output interface 1600, transmits data to an output device such as a display, a speaker, and a printer. The input/output interface 1600 may also function as a media interface that reads a computer program and the like recorded on certain recording media. Examples of the media include optical recording media such as a digital versatile disc (DVD) and a phase change rewritable disk (PD), magneto-optical recording media such as a magneto-optical disk (MO) and the like, tape media, magnetic recording media, or semiconductor memories.

For example, when the computer 1000 functions as the measurement device 100 in the first embodiment, the CPU 1100 of the computer 1000 executes the computer program loaded on the RAM 1200, thereby implementing the functions of the control unit 130 and the like. In the HDD 1400, the computer program for executing the information processing in the present disclosure and the data in the storage unit 120 are stored. Note that, although the CPU 1100 reads and executes the program data 1450 from the HDD 1400, as another example, those computer programs may be acquired from the other device via the external network 1550.

Note that, the present technology can also take the following configurations.

(1) A measurement device comprising:

a base portion;

a plurality of pillars in an arc shape having one end of each close to the base portion and not directly facing one another; and a plurality of acoustic output units installed on each of the pillars and having substantially uniform distances to a certain location.

(2) The measurement device according to (1), wherein the acoustic output units installed on each of the pillars are installed at different heights among the pillars.

(3) The measurement device according to (1) or (2), wherein the acoustic output units are installed such that each of angles formed by a certain reference line and lines connecting the certain location and the acoustic output units installed on a first pillar out of the pillars is different from each of angles formed by the certain reference line and lines connecting the certain location and the acoustic output units installed on a second pillar.

(4) The measurement device according to any one of (1) to (3), wherein the pillars are an odd number of pillars provided on the base portion at substantially the same intervals.

(5) The measurement device according to any one of (1) to (4), wherein the pillars have one end of each close to the base portion and the other end of each coupled by a coupling portion.

(6) The measurement device according to (5), wherein the pillars are three pillars provided at substantially the same intervals in a circumferential direction of an axis connecting the base portion and the coupling portion.

(7) The measurement device according to any one of (1) to (6), further comprising a rotation mechanism unit rotatable in a circumferential direction of an axis connecting the base portion and the certain location and placed on the base portion.

(8) The measurement device according to any one of (1) to (7), further comprising an output unit configured to output a guide indicating reference of a direction of line of vision of a user located at the certain location.

(9) The measurement device according to any one of (1) to (8), wherein the pillar further includes a mechanism configured to make the acoustic output unit movable.

(10) The measurement device according to any one of (1) to (9), wherein the base portion is rotatable in a circumferential direction of an axis connecting the base portion and the certain location, and the pillars are provided to be rotatable in a circumferential direction around the certain location while retaining a distance between the acoustic output unit and the certain location substantially uniform.

(11) A measurement device comprising:

a base portion;

a plurality of pillars in an arc shape connected to the base portion directly or indirectly and not directly facing one another; and a plurality of acoustic output units installed on each of the pillars and having substantially uniform distances to a certain location.

(12) A measurement system comprising:

a measurement device; and a microphone, wherein the measurement device includes a base portion, a plurality of pillars in an arc shape having one end of each pillar close to the base portion and not directly facing one another, and a plurality of acoustic output units installed on each of the pillars and having substantially uniform distances to a certain location, and the microphone is installed at the certain location where distances from the acoustic output units are substantially uniform and configured to acquire sound output from the relevant acoustic output units.

REFERENCE SIGNS LIST

1, 2 Measurement System
100 Measurement Device
10 Base Portion
20, 30, 40 Pillar
50 Chair
55 Fixing Base
60 Coupling Portion
70 Speaker
80 Bottom Frame
85 Connecting Frame
90 Laser Output Unit
110 Communication Unit
120 Storage Unit
130 Control Unit
131 Receiving Unit
132 Output Control Unit
133 Data Acquisition Unit
140 Output Unit
150 In-Ear Microphones
200 Dummy Head Microphone

The invention claimed is:

1. A measurement device, comprising:

a base portion;

a coupling portion;

a plurality of pillars not directly facing one another, wherein a first end of each pillar of the plurality of pillars is closer to the base portion than a second end of each pillar of the plurality of pillars, and the second end of each pillar of the plurality of pillars is coupled by the coupling portion; and a plurality of acoustic output units installed on each of the plurality of pillars, wherein each pillar of the plurality of pillars has an arc shape such that each acoustic output unit of the plurality of acoustic output units installed on each of the plurality of pillars has substantially a same distance to a measurement point, and the measurement point is between the base portion and the coupling portion.

2. The measurement device according to claim 1, wherein the plurality of acoustic output units installed on each of the plurality of pillars are installed at different heights among the plurality of pillars.

3. The measurement device according to claim 1, wherein the plurality of acoustic output units are installed such that each of a first plurality of angles formed by a reference line and a first plurality of lines connecting the measurement point and the plurality of acoustic output units installed on a first pillar of the plurality of pillars is different from each of a second plurality of angles formed by the reference line and a second plurality of lines connecting the measurement point and the plurality of acoustic output units installed on a second pillar of the plurality of pillars.

4. The measurement device according to claim 1, wherein the plurality of pillars include an odd number of pillars on the base portion at substantially same intervals.

5. The measurement device according to claim 1, wherein the plurality of pillars include three pillars at substantially same intervals in a circumferential direction of an axis connecting the base portion and the coupling portion.

6. The measurement device according to claim 1, further comprising a rotation mechanism unit rotatable in a circumferential direction of an axis connecting the base portion and the measurement point, wherein the rotation mechanism unit is placed on the base portion.

7. The measurement device according to claim 1, further comprising an output unit configured to output a guide indicating reference of a direction of line of vision of a user located at the measurement point.

8. The measurement device according to claim 1, wherein the plurality of pillars include a mechanism configured to make an acoustic output unit of the plurality of acoustic output units movable.

9. The measurement device according to claim 1, wherein
the base portion is rotatable in a circumferential direction of an axis connecting the base portion and the measurement point, and
the plurality of pillars are rotatable in a circumferential direction around the measurement point while retaining substantially the same distance between an acoustic output unit of the plurality of acoustic output units and the measurement point.

10. The measurement device according to claim 1, wherein
the coupling portion has a triangular shape, and
the second end of each pillar of the plurality of pillars is coupled to a corresponding side of a plurality of sides of the coupling portion having the triangular shape.

11. The measurement device according to claim 1, wherein
the coupling portion includes an acoustic output unit of the plurality of acoustic output units,
the acoustic output unit is at a center of the coupling portion, and
the acoustic output unit is above the measurement point.

12. A measurement device, comprising:
a base portion;
a coupling portion;
a plurality of pillars not directly facing one another, wherein
the plurality of pillars are connected to the base portion directly or indirectly, and
an end of each pillar of the plurality of pillars is coupled by the coupling portion; and
a plurality of acoustic output units installed on each of the plurality of pillars, wherein
each pillar of the plurality of pillars has an arc shape such that each acoustic output unit of the plurality of acoustic output units installed on each of the plurality of pillars has substantially a same distance to a measurement point, and
the measurement point is between the base portion and the coupling portion.

13. A measurement system, comprising:
a measurement device that includes
a base portion,
a coupling portion,
a plurality of pillars not directly facing one another, wherein
a first end of each pillar of the plurality of pillars is closer to the base portion than a second end of each pillar of the plurality of pillars, and
the second end of each pillar of the plurality of pillars is coupled by the coupling portion, and
a plurality of acoustic output units installed on each of the plurality of pillars, wherein
each pillar of the plurality of pillars has an arc shape such that each acoustic output unit of the plurality of acoustic output units installed on each of the plurality of pillars has substantially a same distance to a measurement point, and
the measurement point is between the base portion and the coupling portion; and
a microphone configured to acquire sound output from relevant acoustic output units of the plurality of acoustic output units, wherein the microphone is installed at the measurement point.

14. A measurement device, comprising:
a base portion;
a coupling portion;
a plurality of pillars not directly facing one another, wherein
a first end of each pillar of the plurality of pillars is closer to the base portion than a second end of each pillar of the plurality of pillars,
the second end of each pillar of the plurality of pillars is coupled by the coupling portion, and
the plurality of pillars include an odd number of pillars on the base portion at substantially same intervals; and
a plurality of acoustic output units installed on each of the plurality of pillars, wherein
each pillar of the plurality of pillars has an arc shape such that each acoustic output unit of the plurality of acoustic output units installed on each of the plurality of pillars has substantially a same distance to a measurement point,
the measurement point is between the base portion and the coupling portion, and
the plurality of acoustic output units installed on each of the plurality of pillars are installed at different heights among the plurality of pillars.

* * * * *